US007530879B2

(12) United States Patent
Wagner et al.

(10) Patent No.: US 7,530,879 B2
(45) Date of Patent: May 12, 2009

(54) APPARATUS FOR REWORKING A STEEL EDGE OF A SKI

(75) Inventors: Josef Wagner, Weilbach (AT); Gerald Höckner, Ried im Innkreis (AT)

(73) Assignee: Wintersteiger GmbH, Ried (AT)

( * ) Notice: Subject to any disclaimer, the term of this patent is extended or adjusted under 35 U.S.C. 154(b) by 361 days.

(21) Appl. No.: 10/587,008

(22) PCT Filed: Jan. 27, 2005

(86) PCT No.: PCT/AT2005/000020

§ 371 (c)(1),
(2), (4) Date: Jul. 21, 2006

(87) PCT Pub. No.: WO2005/072909

PCT Pub. Date: Aug. 11, 2005

(65) Prior Publication Data

US 2008/0242201 A1 Oct. 2, 2008

(30) Foreign Application Priority Data

Jan. 30, 2004 (AT) ..... A 136/2004

(51) Int. Cl.
*B24B 49/00* (2006.01)

(52) U.S. Cl. ..... 451/5; 451/9; 451/10; 451/11; 451/184; 451/260

(58) Field of Classification Search ..... 451/5, 451/8, 9, 10, 11, 184, 190, 260, 261, 267, 451/282; 76/83
See application file for complete search history.

(56) References Cited

U.S. PATENT DOCUMENTS 4,606,150 A * 8/1986 Grimm ..... 451/150

(Continued)

FOREIGN PATENT DOCUMENTS

DE 43 21 450 A1 1/1995

(Continued)

OTHER PUBLICATIONS

International Search Report in English.

*Primary Examiner*—Eileen P. Morgan
(74) *Attorney, Agent, or Firm*—Collard & Roe, P.C.

(57) ABSTRACT

An apparatus is described for reworking a steel edge of a ski (1), comprising at least one grinding apparatus (16) made of a cup-like grinding wheel (18) which is driven by a motor (17) and comprises a rotational axis extending transversally to the direction of feed (10), a bearing block (15) arranged on a feed carriage (9) which forms an oscillating axis (b) for the grinding device (16) extending transversally to the direction of feed (10) and perpendicular to the rotational axis of the grinding wheel (18), a guide means (8) for the feed carriage (9) which is held in a transverse carriage (6) movable transversally to the direction of feed and is rotatable about an axis (a) extending in the direction of feed, and an adjusting device for the angular position of the guide means (8) of the feed carriage (9). In order to achieve an advantageous machining of steel edges it is proposed that the adjusting device for the angular position of the guide means (8) of the feed carriage (9) comprises an actuating drive (11) which can be triggered with the help of a control device depending on the position of the grinding intervention relating to the length of the ski.

9 Claims, 4 Drawing Sheets

U.S. PATENT DOCUMENTS

| | | | | | |
|---|---|---|---|---|---|
| 4,679,356 | A * | 7/1987 | Thomas | 451/558 |
| 4,818,839 | A * | 4/1989 | Chastain | 219/76.14 |
| 5,597,344 | A * | 1/1997 | Bocquet | 451/65 |
| 5,954,568 | A * | 9/1999 | Wirz | 451/47 |
| 6,086,465 | A * | 7/2000 | Mayr | 451/293 |
| 6,805,622 | B1 * | 10/2004 | Dorner | 451/358 |

FOREIGN PATENT DOCUMENTS

| | | | |
|---|---|---|---|
| EP | 1 228 840 | A | 8/2002 |
| WO | WO 87/06868 | A | 11/1987 |
| WO | WO 98/04384 | A | 2/1998 |

* cited by examiner

APPARATUS FOR REWORKING A STEEL EDGE OF A SKI

CROSS REFERENCE TO RELATED APPLICATIONS

Applicants claim priority under 35 U.S.C. §119 of Austrian Application No. A 136/2004 filed Jan. 30, 2004. Applicants also claim priority under 35 U.S.C. §365 of PCT/AT2005/000020 filed Jan. 27, 2005. The international application under PCT article 21(2) was not published in English.

1. Field of the Invention

The invention relates to an apparatus for reworking a steel edge of a ski, comprising at least one grinding apparatus made of a cup-like grinding wheel which is driven by a motor, comprising a rotational axis extending transversally to the direction of feed, a bearing block arranged on a feed carriage which forms an oscillating axis for the grinding device extending transversally to the direction of feed and perpendicular to the rotational axis of the grinding wheel, a guide means for the feed carriage which is held in a transverse carriage movable transversally to the direction of feed and is rotatable about an axis extending in the direction of feed, and an adjusting device for the angular position of the guide means of the feed carriage.

2. Description of the Prior Art

In order to enable the machining of the lateral edges of skis, i.e. their steel edges in the lateral and bottom edge region, with the help of a grinding tool in an advantageous manner, it is known (WO 98/04384 A1) to provide a cup-like grinding wheel which is held in a freely rotatable manner on an oscillating axis extending in a stop-delimited manner relative to its rotational axis and its direction of feed and is connected with a feed drive, so that the cup wheel can be placed on the steel edge in a self-aligning manner. The cup wheel rests on the machining surface of the steel edge in two circumferential areas which are opposite of each other with respect to a chord, which allows an automatic adjustment of the cup disk about the oscillating axis even in the sidecut section of the skis. The optional machining of the lateral or bottom edge is enabled by a pivoting adjustment of the grinding device about an axis extending in the direction of feed. A pivoting stop determines the respective angular position of the grinding device and thus the angle of the steel edge in the lateral or bottom edge region. The desired grinding angle can be set in the lateral and bottom edge region can be set by means of an adjusting of said pivoting stops.

It is further known for the simultaneous machining of the lateral edges of two skis held in a manner suitable for machining (EP 1 228 840 A1) to provide two grinding devices with cup-like grinding wheels. Under the precondition that the grinding wheels project beyond the grinding device by an amount required for machining the lateral edges, it is thus possible to engage into the intermediate space between the two skis received in a ski holding device in order to grind one of the two mutually facing lateral edges of the skis without impairing the respective other ski. For this purpose, the grinding device merely needs to be placed on the lateral edge of the ski to be machined by means of a feed device and the ski holding device needs to be moved in the direction of feed relative to the grinding device. To ensure that the grinding devices can be aligned easily relative to the lateral edges to be machined, the feed carriages receiving the grinding devices are held on transverse carriages which are displaceable independent from each other. For the purpose of machining the bottom or lateral edges of the skis, the guide means for the feed carriages of the grinding devices in the transverse carriages can be swiveled about an axis extending in the direction of feed between the basic positions with limit stops for the alternate machining of the bottom and lateral edges, which occurs with the help of pivoting cylinders.

Irrespective of whether only one or two grinding devices are provided, the cup-like grinding wheel is placed on the face side against the steel edge section to be ground under a predetermined angle which determines the later edge angle of the machined steel edge and is maintained precisely over the length of the ski. Despite maintaining the edge angle over the length of the ski precisely, there is a gliding and guiding behavior of the steel edges which becomes less satisfactory with increasing sidecut of the skis, especially under higher loads as occur in ski racing.

In order to facilitate the twisting of a ski it is finally known (WO 87/06868 A1) to grind the steel edges in the bottom edge region starting from the sidecut middle region against the widening ski ends with an increasing angle of attack. For this purpose, the grinding wheels are held on guide places which are held transversally to the longitudinal direction of the skis in an adjustable way, namely with the help of guide pins of which the guide pins averted from the ski are guided in a link inclined relative to the running surface of the ski about an axis of the length of the ski, whereas the guide pins facing the ski engage in guide means parallel to the running surface. Since the guide plates rest by way of guide rollers on the lateral edges of the ski, the guide plates are pressed apart towards the ends of the ski against the force of a spring with the effect that the inclination of the plates and, with the inclination of the plates, the angle of attack of the grinding wheel increases. Apart from the fact that with the help of this known grinding apparatus it is only possible to provide a change of the angle of attack of the grinding wheels which is dependent on the ski width and is predetermined constructionally, it has been seen that the desired precise guidance of the ski cannot be achieved with such a machining of the edges.

SUMMARY OF THE INVENTION

The invention is thus based on the object of providing an apparatus for reworking a steel edge of a ski of the kind mentioned above in such a way that the steel edges can be ground repeatedly in such a way that advantageous gliding and guiding properties for the ski are obtained which are advantageous for the respective requirements.

This object is achieved by the invention in such a way that the adjusting device for the angular position of the guide means of the feed carriage comprises an actuating drive which can be triggered with the help of a control device depending on the position of the grinding intervention relating to the length of the ski.

By providing an actuating drive for the adjusting device of the angular position of the guide means of the feed carriage, it is easily possible, in conjunction with a respective control device for controlling this adjusting device, to change the edge angle of the steel edges of a ski both in the region of the lateral and bottom edges in a predetermined manner over the length of the ski, thus entailing the desired improvements in the riding and guiding behavior of the ski because it has been seen that with the machining of the bottom edge per se it is not possible to have a sufficient influence on the riding properties. In order to take the different requirements placed on edge grip in the area of the binding and in the area of the ends of the ski into account, it is necessary to have a sufficiently precise actuating drive for the adjusting device. This is achieved advantageously when the actuating drive comprises a controlled electric stepper motor with a low-play gear which is connected with the guide means for the feed carriage. A separate pivoting drive can thus be omitted with the use of such a stepper motor in order to adjust the guide means for the feed carriage between the grinding positions for the bottom and lateral edge of the ski because this changeover of the basic positions of the grinding device can be made via the actuating drive.

The alignment of the grinding device corresponding to the progress of the edge via the oscillating axis extending perpendicular to the rotational axis of the grinding wheel and transversally to the direction of feed leads to the consequence that the cup-like grinding wheel needs to rest on the face side in the region of two circumferential sections on the steel edge of the ski extending in a chord-like manner relative to the grinding wheel, which may lead to difficulties in the end regions of the ski when the steel edge needs to be machined up to the end region under adherence to precise grinding angles. In order to avoid these difficulties, the grinding device can be torsionally rigidly connected with the bearing block via a fixing device, so that the grinding wheel, for the purpose of machining the ends of the ski, can also be used by resting on one side on the steel edge to be ground.

In order to obtain a precise guidance of the transverse carriage relative to the ski which causes a movement of the transverse carriage transversally to the direction of feed as a result of its sidecut portion, a double-arm lever can be held on the transverse carriage, which lever comprises two guide rollers provided on either side of the grinding device for the lateral longitudinal edges of the ski, so that an automatic contact of the guide rollers on the lateral longitudinal edges of the ski is obtained via a possible oscillating movement of the double-arm lever. This support of the transverse carriage relative to the ski which is held in a manner suitable for machining is only effective when both guide rollers rest on the ski. To ensure that a support can be enabled via one guide roller only which is necessary in the end regions of the ski, the lever with its guide rollers in its respective pivoting position can be joined in a torsionally rigid manner with the transverse carriage by a fixing device.

The control device for changing the edge angle to be ground over the length of the ski offers the simple possibility to even control other grinding parameters depending on the position of the grinding intervention which depends on the length of the ski. As a result, the grinding pressure can be set to a different pressure by a respective triggering of the feed cylinder of the feed carriage and the speed of the grinding wheel and/or the feeding speed can be changed in order to have a respective influence on the surface quality of the grinding surfaces, which in conjunction with a respective configuration of the edge angle has an advantageous effect on the guidance and hold of the ski on a solid or icy base.

To ensure that the grinding parameters can be adjusted to different conditions, it is necessary that the respective control parameters for grinding the ski edge must be predetermined for the control device for determining the reference variables. For this purpose the control device can advantageously comprise an interface for entering these control parameters.

Since after the machining of a ski is no longer possible to determine without complex measuring methods under which control parameters the ski edge was ground (any changes of the edge angle in the magnitude of 0.1° have an influence on the riding behavior), it is recommended to state the respective control parameters for the grinding of the ski edge on the ski. For this purpose, a writing device for a preferably machine-readable identifier of the respective control parameters can be triggered via a control device, that the label with this identifier can be applied to the ski, preferably glued onto the same. In the case of machine-readable identifiers, the respective control parameters for a repeated reworking of the ski edges can be read automatically into the control device in order to be changed in sections in order to optionally improve the riding behavior.

BRIEF DESCRIPTION OF THE DRAWINGS

The subject matter of the invention is shown in the drawings by way of example, wherein.

DESCRIPTION OF THE PREFERRED EMBODIMENTS

Figure 1:
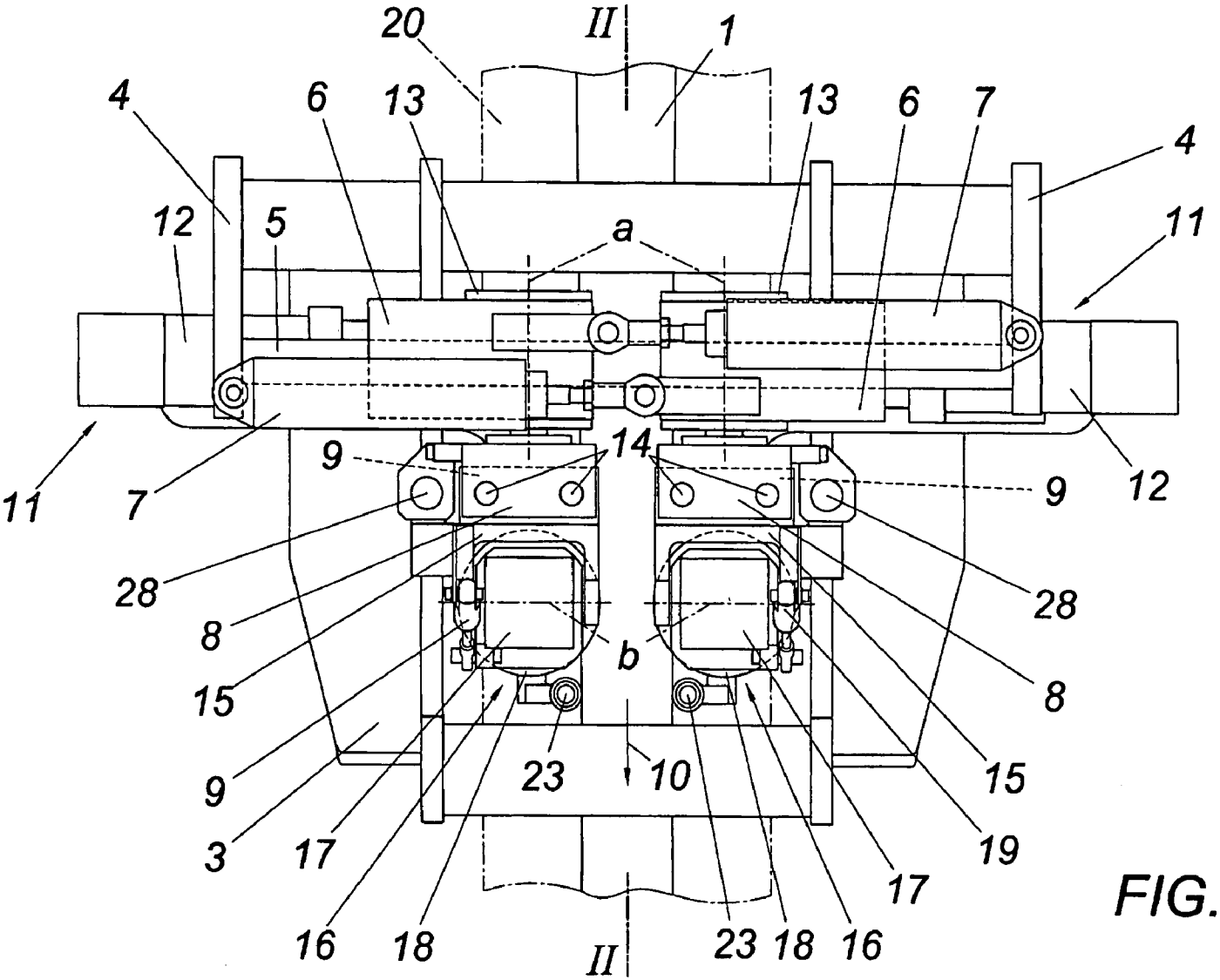
FIG. 1 shows a simplified top view of an apparatus in accordance with the invention for reworking a steel edge of a ski.

The illustrated apparatus for machining a steel edge of a ski 1 comprises a frame 3 which is displaceable in respective of its height in a housing (not shown in closer detail) on vertical guide means 2 and which can be adjusted via lifting cylinders along the guide means 2. Guide rods 5 for two transverse carriages 6 are provided in outer lateral cheeks 4 of the frame 3, which transverse carriages are displaceable along the guide rods 5 by means of actuating cylinders 7 acting on the one hand upon the lateral cheeks 4 and on the other hand on the transverse carriages 6. Guide means 8 for feed carriages 9 are rotatably held on the transverse carriages 6, namely about a rotational axis a extending in the direction of feed 10 of the ski 1, as indicated in FIGS. 1 and 2 with the dot-dash line.

An actuating drive 11 is provided for turning the guide means 8, which drive consists according to the embodiment of an electric stepper motor 12 and a low-play gear 13, preferably a bevel gear, with the guide means 8 resting in a torsionally rigid manner on the output shaft of said bevel gear. The feed carriage 9 guided on the guide rods 14 of the guide means 8 carries a bearing block 15 for the grinding device 16 which comprises a motor 17 and a cup-like grinding wheel 18 and is rotatably held in the bearing block 15 about an oscillating axis b extending perpendicular to the rotational axis of the cup like grinding wheel 18 and is aligned transversally to the direction of feed 10. As a result, an automatic adjustment of the alignment of the grinding wheel 18 relative to the progress of the steel edge is achieved without changing the edge angle set by the actuating drive 11 via the bevel gear 13. In order to enable the continuation of the grinding process in the end region of the skis when the circumferential section, which is the one on the front face side in the direction of feed 10 of the grinding device 16, is moved beyond the grinding area, the grinding device 16 can be torsionally rigidly connected with the bearing block 15 by way of a locking device 19, which is achieved in the present embodiment by a locking cylinder between the bearing block 15 and the grinding device 16.

Figure 2:
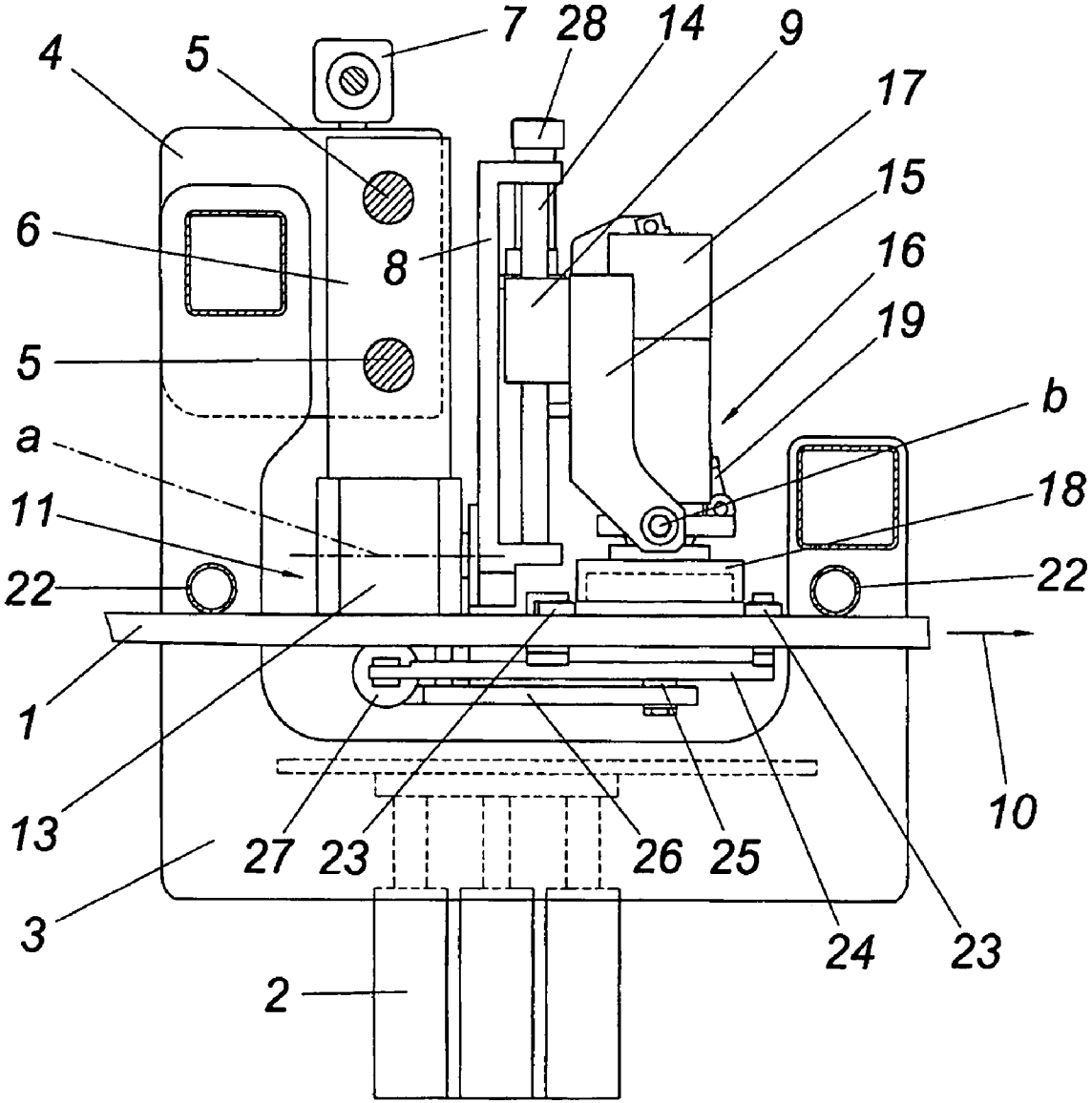
FIG. 2 shows a sectional view along line II-II in FIG. 1.
Figure 3:
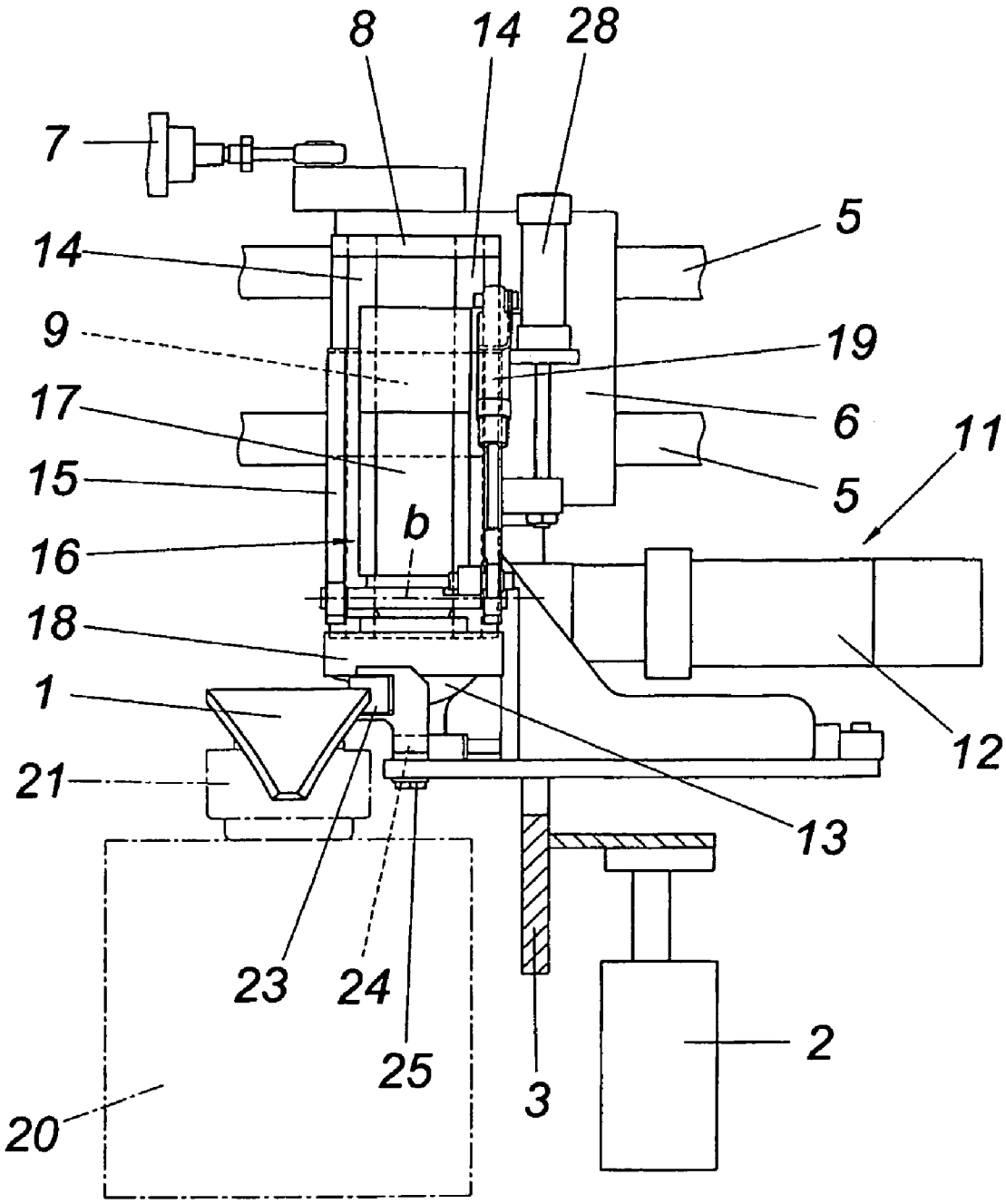
FIG. 3 shows the apparatus according to FIG. 1 in a sectional front view in the area of the transverse carriage.
Figure 4:
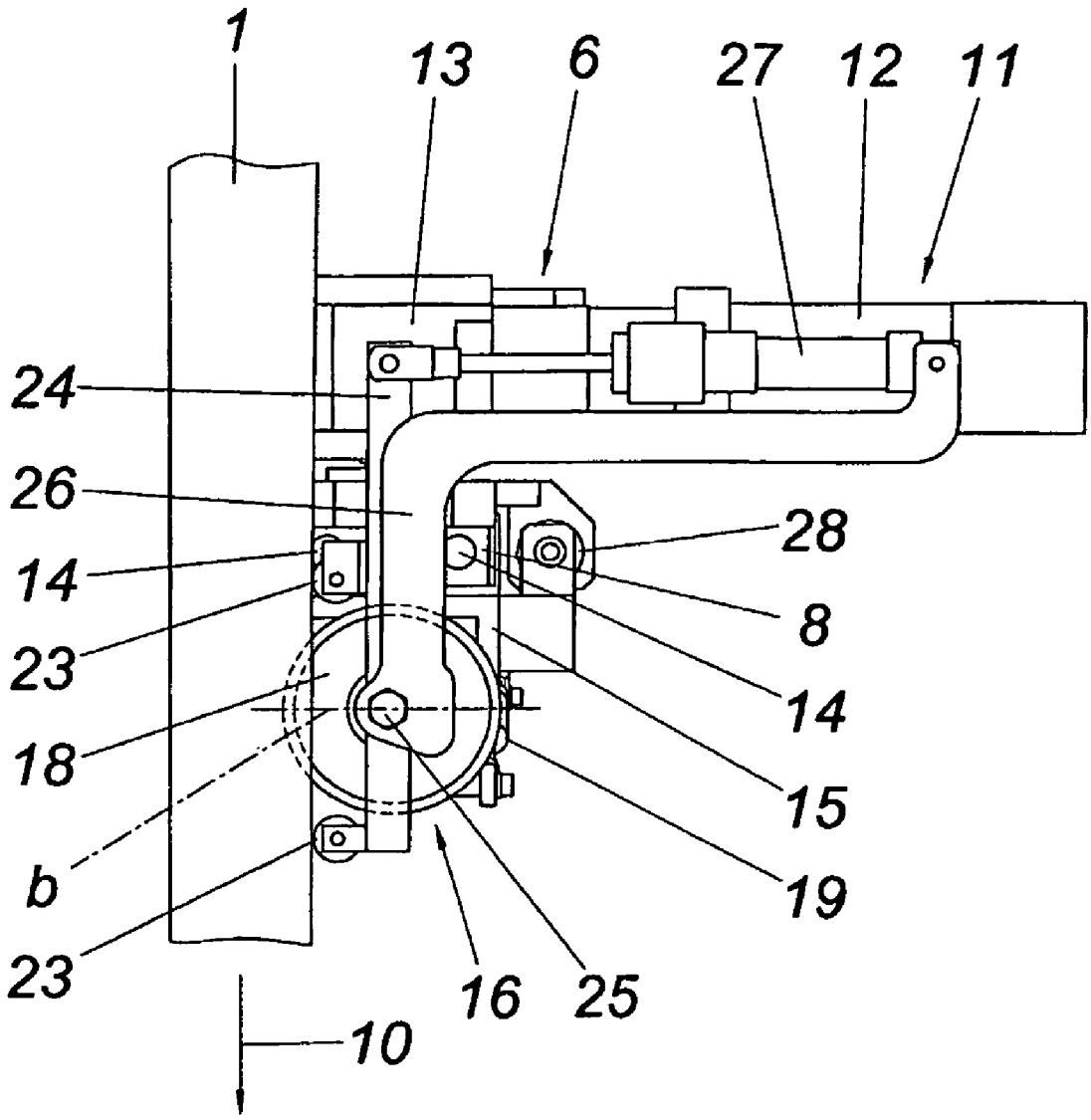
FIG. 4 shows the transverse carriage with the grinding device according to FIG. 3 in a bottom view.

Ski 1 is clamped in a manner ready for machining on a longitudinal carriage 20 (merely indicated in FIGS. 1 and 3 with a dot-dash line) on rubber-elastic supports 21, so that during the lowering of the frame 3 over the guide means 2 holding-down rollers 22, which are held in the frame 3, are lowered onto the running surface of the ski 1 and determine a reference plane for machining the steel edges, as is shown in FIG. 2. For the purpose of aligning the transverse carriages 6 relative to the associated longitudinal edges of ski 1, guide rollers 23 are each provided in the transverse carriages 6, which guide rollers are held on a double-arm lever 24 which is linked in the region of the cup-like grinding wheel 18 via a shaft 25 to a support arm 26 of the respective transverse carriage 6. As a result of a free oscillating movement of the lever 24 about the pivoting axis 25, the guide rollers 23 can always rest on both sides of the grinding wheel 18 on the lateral edges of the ski. The free pivoting movement of the lever 24 can be blocked by means of a locking device 27 in the form of a locking cylinder, so that a lateral guidance for the carriage 6 is also obtained when one of the two guide rollers 23 already lies outside of the lateral edge of the ski 1.

The carriages 6 which are displaced via the actuating cylinders 7 against the longitudinal edges of ski 1 until the guide rollers 23 rest on the lateral edges, always assume a certain position relative to the longitudinal section of ski 1 which is in grinding engagement as a result of the follow-up guidance secured by way of the guide rollers 23 even in the case of skis with a strong sidecut. The feed carriage 9 for the grinding device 16 can be subjected to a predeterminable grinding pressure. For this purpose, a feed cylinder 28 resting on the guide means 8 engages on the feed carriage 9.

In contrast to conventional grinding devices, the preconditions are created by the actuating drive 11 of the adjusting device for the angular position of the guide means 8 of the feed carriage 9 to change said angular position and thus the edge angle of the steel edge during the grinding process. For this purpose a control device is provided which triggers the actuating drives 11 depending on the position of the grinding intervention relating to the ski length in such a way that different angles are obtained in certain longitudinal sections. It is additionally possible to distinguish between the outside and the inner edge of the ski 1. Since it is possible to have a respective influence according to the respective requirements via the control device without any additional effort on the feed speed of the ski relative to the grinding device, the speed of the grinding device and/or the grinding pressure depending on the position of the grinding intervention relating to the length of the ski, the running and guiding properties of a ski 1, especially under racing conditions, can be adjusted in a fine-tuned manner to the conditions of the snow and the slope and to the skier's riding style with the help of the apparatus in accordance with the invention.

It is understood that the invention is not limited to the illustrated embodiment. The adjusting device for the grinding angle can also comprise an actuating drive for the known stops for the guide means 8 of the feed carriage 9.

The direction of feed 10 which is obtained from the relative movement of the carriage 20 receiving the ski 1 relative to the grinding device 16 is given by way of example only because the machining of steel edges is obviously also possible in an opposite direction of feed, which will always be utilized in cases when the machining occurs in several stages in a reciprocating manner.

The invention claimed is:

1. An apparatus for finishing a steel edge of a ski of a selected length comprising:

(a) at least one grinder comprising a motor and a cup-shaped grinding wheel driven by said motor, said grinding wheel having an axis of rotation extending transversely to a feed direction;

(b) a setting carriage;

(c) a bearing block arranged on the setting carriage and rotatably mounting the at least one grinder, the bearing block forming a pendulum axis extending transversely to the feed direction and perpendicularly to the axis of rotation of the grinding wheel;

(d) a transverse carriage movable transversely to the feed direction;

(e) a guide for the setting carriage rotatably mounted in the transverse carriage about a guide axis extending in the feed direction, the setting carriage being guided on the guide;

(f) a control device; and (g) an adjusting device for adjusting angular position of the guide, said adjusting device comprising an adjusting drive adapted to be controlled by the control device in dependence upon position of grinding engagement of the grinding wheel in relation to the length of the ski.

2. The apparatus according to claim 1, wherein the adjusting drive comprises a controlled electric stepper motor with a low-play gear which is connected with the guide.

3. The apparatus according to claim 1, wherein the at least one grinder is connected with the bearing block in a rotationally secure way by a locking device.

4. The apparatus according to claim 1, wherein a double-arm lever is held on the transverse carriage, said lever comprising two guide rollers provided on either side of the at least one grinder for the lateral longitudinal edges of the ski.

5. The apparatus according to claim 4, wherein the lever with the guide rollers is connected in its respective pivoting position in a rotationally secure way with the transverse carriage by a locking device.

6. The apparatus according to claim 1, wherein an adjusting cylinder engages on the setting carriage, said adjusting cylinder being controlled by the control device depending on the position of the grinding engagement in relation to the length of the ski.

7. The apparatus according to claim 1, wherein the grinding wheel has a grinding wheel speed, at least one of the grinding wheel speed and a feed speed of the ski in relation to the grinding wheel being changeable depending on the position of the grinding engagement in relation to the length of the ski.

8. The apparatus according to claim 1, wherein the control device comprises an interface for entering control parameters for grinding the ski edge.

9. The apparatus according to claim 1, wherein a recording device for a machine-readable characterization of the control parameters for grinding the ski edge can be controlled by way of the control device.

* * * * *